United States Patent [19]

Sharp

[11] 3,969,281

[45] July 13, 1976

[54] WATER-SOLUBLE IMIDAZOLINE COMPOSITION FOR REMOVING IRON SULFIDE AND SLUDGE FROM METAL SURFACES

[76] Inventor: Thomas L. Sharp, 715 Nenana St., Houston, Tex. 77035

[22] Filed: Sept. 23, 1974

[21] Appl. No.: 508,655

[52] U.S. Cl. ..... 252/542; 134/22 C; 134/34; 252/544; 252/547

[51] Int. Cl.[2] ..... C11D 1/62; C11D 1/835; C11D 3/30

[58] Field of Search ..... 134/22 C, 34; 252/542, 252/547, 544

[56] References Cited

UNITED STATES PATENTS

| | | | |
|---|---|---|---|
| 2,356,254 | 8/1944 | Lehmann et al. | 134/22 C |
| 3,325,310 | 6/1967 | Barusch | 134/22 C |
| 3,794,523 | 2/1974 | Thompson | 134/22 C |

OTHER PUBLICATIONS

B359,946, Jan. 1975, Sutton.

*Primary Examiner*—Thomas J. Herbert, Jr.
*Attorney, Agent, or Firm*—Arnold, White & Durkee

[57] ABSTRACT

A water-soluble composition capable of removing iron sulfide and sludge from metal surfaces and a method of such removal of iron sulfide and sludge from metal surfaces, particularly in a glycol system, the composition comprising:

a. from about 2 to about 15% by weight of a high molecular weight linear diamine;

b. from about 2.5 to about 18% by weight of acetic acid;

c. from about 1 to about 10% by weight of an organic nitrogen substituted imidazoline;

d. from about 6 to about 15% by weight of a non-ionic surfactant;

e. from about 2 to about 8% by weight of a quaternary ammonium chloride;

f. from about 1 to about 15% by weight of an alcohol solvent; and g. the remainder, water.

In the method of removing iron sulfide and sludge from interior metal surfaces, particularly in a glycol system, the above composition is added to the effluent of the glycol system for onstream treatment in an amount effective to remove the iron sulfide and sludge. Generally, the composition is added to the effluent in an amount of from about 200 to about 1,000 parts per million of effluent.

6 Claims, No Drawings

WATER-SOLUBLE IMIDAZOLINE COMPOSITION FOR REMOVING IRON SULFIDE AND SLUDGE FROM METAL SURFACES

BACKGROUND OF THE INVENTION

Field of the Invention

This invention relates to a water-glycol soluble liquid capable of removing iron sulfide and sludge from metal surfaces, particularly metal surfaces in a glycol system, and to a method of removing such iron sulfide and sludge from interior metal surfaces, wherein the composition of the present invention is employed onstream. More particularly, the present invention is directed to such waterglycol soluble liquid composition and method of removing iron sulfide and sludge therewith, wherein an amine salt formed in situ by reaction of acetic acid and a high molecular weight linear diamine is a principal active ingredient thereof.

SUMMARY OF THE INVENTION

Due to the difficulties generally encountered in the removal of iron sulfide and sludge from metal surfaces in various systems, including glycol systems, a composition was developed in accordance with the present invention which effectively allows penetration of a film crust of iron sulfide and associated sludge. This provides for dispersion of the iron sulfide and sludge in finally divided solid form, allowing easy removal from the system. The composition of the present invention, effective for the removal of iron sulfide and sludge from metal surfaces, comprises:

a. from about 2 to about 15% by weight of a high molecular weight linear diamine;

b. from about 2.5 to about 18% by weight of acetic acid;

c. from about 1 to about 10% by weight of an organic nitrogen substituted imidazoline;

d. from about 6 to about 15% by weight of a non-ionic surfactant;

e. from about 2 to about 8% by weight of a quaternary ammonium chloride;

f. from about 1 to about 15% by weight of an alcohol solvent; and g. the remainder, water.

The method of the present invention is carried out to remove iron sulfide and sludge from interior metal surfaces, particularly in a glycol system, by adding to the effluent of the system for in-line, onstream treatment an effective iron sulfide and sludge removing amount of the above composition. Generally, such composition is employed in accordance with the present invention in an amount of about 200 to about 1,000 parts per million of effluent.

Accordingly, it is a principal feature of the present invention to provide a water-glycol soluble composition capable of removing iron sulfide and sludge from metal surfaces, wherein such composition effectively disperses iron sulfide and sludge in finally divided solid form, thereby allowing effective removal of the same;

It is a further feature of the present invention to provide such water-glycol soluble composition capable of removing iron sulfide and sludge from metal surfaces, particularly in a glycol system, wherein such composition includes as a principal active component thereof an amine salt formed in situ from a high molecular weight linear diamine and acetic acid;

It is yet a further feature of the present invention to provide such water-glycol soluble composition capable of removing iron sulfide and sludge from metal surfaces, wherein the composition comprises a high molecular weight linear diamine, acetic acid, an organic nitrogen substituted imidazoline, a non-ionic surfactant, a quaternary ammonium chloride, an alcohol solvent, and water.

It is still a further feature of the present invention to provide a method of removing iron sulfide and sludge from interior metal surfaces, particularly in a glycol system, which method comprises adding to the effluent of the system for in-line onstream treatment an effective iron sulfide and sludge removing amount of the composition of the present invention.

Yet a further feature of the present invention involves such method of removing iron sulfide and sludge from interior metal surfaces, wherein the composition of the present invention is employed in an amount of from about 200 to about 1,000 parts per million of effluent.

Still further features and advantages of the present invention will become apparent from the following more detailed description thereof.

DESCRIPTION OF PREFERRED EMBODIMENTS

The foregoing features of the present invention and the advantages associated therewith are associated with a water-glycol soluble composition which is effective in the removal of iron sulfide and sludge from metal surfaces, particularly in a glycol system. The composition of the present invention and the method of utilizing the same allow the effective removal of the iron sulfide and sludge through a combination of componenents which provides for penetration of the film crust on the interior metal surfaces and dispersion of the iron sulfide and sludge as finally divided solids. The composition of the present invention can be utilized in small quantities to disperse large amounts of iron sulfide and sludge and provides only slight discoloration of the effluent utilized. Where desired, a filter or other similar means can be utilized to extract a high content of the dispersed iron sulfide and/or sludge.

The composition of the present invention has as a principal active component an amine salt formed in situ by the reaction of two of the composition's components, a high molecular weight linear diamine and acetic acid. This amine salt, which is formed in situ, has a polar attraction for the iron present in the iron sulfide and sludge and, presumably due to this polar attraction, effectively dislodges the iron ions from the sludge, attaching to the metal surfaces in the form of a corrosion-inhibiting barrier. A further active component in the composition of the present invention is a partial amide-amine diacetate formed in situ by the reaction of acetic acid and an organic nitrogen substituted imidazoline. This component also is effective to dislodge the iron ions from the sludge, dispersing the same for easy removal.

The remaining components of the composition of the present invention in a secondary manner act as solvents and surface active components, providing for the dissolving of the active components and the necessary penetration of the composition through the sludge. These components are a non-ionic surfactant, preferably a linear alcohol polyglycol ether, a quaternary ammonium chloride, preferably an alkyl dimethyl benzyl ammonium chloride, an alcohol solvent, preferably diacetone alcohol, and water.

The composition of the present invention generally has a pH within the range of 4.5 to 6, the pH generally being around pH 5.0–5.2.

When carrying out the method of the present invention, the composition of the present invention can be added directly to the effluent stream of a glycol system to provide in-line, onstream treatment effective for the removal of iron sulfide and sludge. Alternatively, prior to introduction, the composition of the present invention can be mixed with the effluent in any desired proportion. The composition of the present invention is employed in an amount effective to provide the desired removal of the iron sulfide and sludge, with an amount of about 200 to about 1000 parts of the composition of the present invention per million parts of effluent being generally employed. It should be apparent, however, that depending upon the nature of the sludge, and depending upon the amount of the iron sulfide and sludge deposit, the composition of the present invention can be employed in slightly greater or lesser amounts than described above.

The onstream ability of the composition of the present invention to effectively remove iron sulfide and sludge is an advantage of the composition and method of the present invention over previously developed systems. Accordingly, when utilizing the composition and method of the present invention, it is unnecessary to shut down the system and the simple introduction of the composition of the present invention into the effluent stream in an amount effective to remove the iron sulfide and sludge is all that is required. This provides for great economic savings.

The composition of the present invention will now be described by reference to the individual components, including preferred embodiments thereof, with specific reference being made to the weight percentage of each component in the composition of the present invention. It should be understood that more than one of each of the following components can be effectively utilized.

High Molecular Weight Linear Diamine

The diamine employed in the composition of the present invention is a high molecular weight linear diamine, preferably a diamine having a carbon chain derived from a higher fatty acid. In accordance with the preferred embodiment of the present invention, such diamine contains from 12 to 30 carbon atoms, with exemplary diamines useful in accordance with the present invention including, for example, tallow diamine having an amine value of 325 to 240, or coco diamine having an amine value of about 400. Of course, any and all diamines falling within the above description of carbon chain length can be applicably utilized in accordance with the present invention.

The diamine is employed in an amount of from about 2 to about 15% by weight, preferably 3 to 8% by weight. In the most preferred embodiment of the present invention, the diamine is employed in an amount of 4 to 6% by weight. Of course, slight deviations from the foregoing amounts can be tolerated, and the use of slightly greater or lesser amounts is still within the spirit and scope of the present invention.

Acetic Acid

Any industrial or commercial form of acetic acid can be advantageously utilized in the composition and method of the present invention. The acetic acid is generally employed in an amount of from about 2.5 to about 18% by weight, preferably 3 to 8% by weight. In the most preferred embodiment of the present invention, the acetic acid is employed in an amount of 3 to 5% by weight. Here again, as was the case with respect to diamine, slight deviations from these amounts are within the scope of the present invention.

As previously indicated, it is presumed that the amine and acetic acid react in situ to form a salt, i.e., amine diacetate. This is the principal active component of the composition of the present invention, which component is responsible for the dislodgement and dispersion of the sludge and iron sulfide in the oil system.

Organic Nitrogen Substituted Imidazoline

A third component of the composition of the present invention is an organic nitrogen substituted imidazoline. This component also reacts in situ with the acetic acid, forming a partial amide-amine effective to dislodge and disperse iron sulfide and sludge. This component can be represented by the formula:

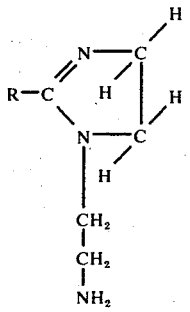

wherein R is an alkyl radical.

In the preceding formula, R is preferably a long chain alkyl radical derived from a fatty acid. Most preferably, R has from about 12 to about 20 or more carbon atoms. A typically preferred R radical is one derived as follows: 46% oleic acid; 41% linoleic acid; and 13% other fatty acids (predominantly $C_{18}$).

The organic nitrogen substituted imidazoline is employed in the composition of the present invention in an amount of from about 1 to about 10% by weight, preferably 2–5% by weight, based on the weight of the composition. In the most preferred embodiment of the present invention, this component is employed in an amount of 2–3% by weight. Of course, slightly lesser or greater amounts of this component can be employed where desired for particular purposes.

Non-ionic Surfactant

Any water soluble surfactant can be advantageously utilized in the composition of the present invention. Generally, the surfactant is a non-ionic surfactant, with adducts of ethylene oxide and alcohols or alkyl phenols being preferred. These preferred surfactants can be generically referred to as linear alcohol polyglycol ethers and alkylphenol polyethoxy ethers.

Generally, the linear alcohol contains from about 6 to about 16 carbon atoms, preferably 8–12 carbon atoms, and the alkyl group of the alkylphenol contains a similar number of carbon atoms. The number of ethylene oxide groups introduced into the surfactant molecule can vary over wide limits, although the surfactants generally have from about 3 to about 20 ethylene oxide groups, with from about 8 to about 12 ethylene oxide groups being preferred. Various commercially available non-ionic surfactants such as sold under the series names Triton, Igepol, among others, are applicable. Descriptions of these and other surfactants useful in the composition of the present invention can be found in the *Encyclopedia of Surface Active Agents*, Vol. II, 1964, hereby incorporated by reference.

The surfactant is employed in the composition of the present invention to reduce the interfacial tension of the composition when employed in a water soluble system, e.g., a glycol system. In addition, however, it has been discovered that, due to the action of the surfactant, the composition of the present invention can be used in an oil system, particularly where there is sufficient dispersion of the active components of the instant composition.

In the composition of the present invention, the surfactant is generally employed in an amount of from about 6 to about 15% by weight, preferably 8 to 13% by weight, based on the weight of the composition. In the most preferred embodiment, the surfactant is employed in an amount of 10 to 12% by weight. Here again, for particular purposes, slightly lesser or greater amounts of surfactant can be used.

Quaternary Ammonium Chloride

The composition of the present invention also includes a minor amount of a quaternary ammonium cloride. These materials, although known for their bacteriacidal activity, provide unusual surface active characteristics to the instant composition. Preferably, this component is an alkyl (or dialkyl) dimethyl benzyl ammonium chloride, with the alkyl group varying from $C_8$ to $C_{20}$, preferably $C_{12}$ to $C_{16}$. A suitable commercially available material has the following alkyl group: $C_{14}$ - 50%; $C_{12}$ - 40%; $C_{16}$ - 10%.

Other representative quaternary ammonium compounds include:

Didecyl Dimethyl Ammonium Chloride
Octyl Decyl Dimethyl Ammonium Chloride
Dioctyl Dimethyl Ammonium Chloride The quaternary ammonium compound is generally employed in an amount of from about 2 to about 8% by weight, preferably 4 to 7% by weight, based on the weight of the composition. Most preferably, the quaternary ammonium compound is employed in an amount of 4.5 to 6.5% by weight.

Alcohol Solvent

A solvent employed in the composition of the present invention is an alcohol solvent. This material can be any conventional solvent material having an alcoholic function. Preferably, the alcoholic solvent is a material selected from lower aliphatic solvents and diacetone alcohol. Diacetone alcohol is preferred due to the higher flash point this alcohol solvent contributes to the composition, as compared, for example, with the lower aliphatic alcohols. The lower aliphatic alcohols are generally those having up to 6 carbon atoms with isopropyl alcohol being preferred. Of the alcohol solvents applicable in accordance with the present invention, the best results with respect to penetration of the iron sulfide and sludge for dispersion of the same and removal of the same is achieved utilizing diacetone alcohol.

The alcohol solvent is generally employed in an amount of from about 1 to about 15% by weight, preferably 5 to 10% by weight based upon the weight of the composition. In the most preferred embodiment of the present invention, the alcohol solvent is employed in an amount of 8 to 10% by weight. Again, as was the case with regard to the previously discussed components, slightly lesser of greater amounts of the alcohol solvent can be utilized in the composition of the present invention.

Water

The remainder of the composition of the present invention is water.

In addition to formulation of the composition of the present invention in accordance with the percentages described above, the relative ratios of the various components can be maintained while reducing the amount of water, thereby providing a composition in a more concentrated form. This concentrate can then be mixed with additional water prior to use or can be mixed with the effluent of the system in which it is to be used to provide a composition of desired formulation. All of these embodiments fall within the scope of the present invention.

The method of the present invention is preferably carried out by adding the composition described above to the effluent of a water-glycol system. A particular advantage of this method is that treatment for the removal of iron sulfide and sludge can be carried out onstream, and it is unnecessary to shut down operations for this cleaning. The composition can be added directly to the effluent onstream, or can first be diluted with additional effluent prior to addition. In either event, the composition is employed in an amount effective to remove the iron sulfide and sludge present in the system. Generally, it is employed in an amount of from about 200 to about 1,000 parts of composition per million parts of effluent.

The present invention will now be described by reference to the following example. It must be understood that such example is presented solely for purposes of illustration, and the present invention cannot, under any circumstances, be deemed limited thereby.

EXAMPLE

In this example, the following composition was utilized: 4.5% tallow diamine, 3.5% acetic acid, 2.5% organic nitrogen substituted imidazoline of the formula

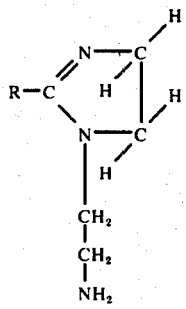

wherein R is 46% oleic, 41% linoleic, and 13% other $C_{18}$ fatty acid group,

10% linear alcohol polyglycol ether (9 to 10 mols EO); 6.25% alkyl dimethyl benzyl ammonium chloride ($C_{14}$ - 50%; $C_{12}$ - 40%; $C_{16}$ - 10%); 8% diacetone alcohol, remainder water.

The above composition was employed to clean a gas-producing plant having a 700 gallon glycol system . . . −10° F. at gas to gas chiller. Five gallons of the above composition were utilized per day for three days by addition to glycol accumulator. After first treatment, gas to gas chiller temperature went to −14° F. in ten minutes. Temperature climbed back to −10° F. in one hour. The next day after second treatment, temperature went from −14° F. to −11° F. Third day temperature went from −11° F. and remained stable. This illustrates the effectiveness of the above composition in removing iron sulfide and sludge.

While the present invention has been described primarily with respect to the foregoing exemplifications of preferred materials and amounts, the present invention cannot in any way be limited thereto, but, rather, must be construed as broadly as any and all equivalents thereof.

What is claimed is:

1. A water soluble composition effective for the removal of iron sulfide and sludge from interior metal surfaces comprising:

a. from about 2 to about 15% by weight of a high molecular weight diamine;
b. from about 2.5 to about 18% by weight of acetic acid;
c. from about 1 to about 10% by weight of an organic nitrogen substituted imidazoline of the formula

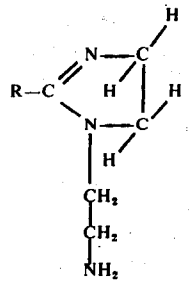

wherein R is an alkyl radical d. from about 6 to about 15% by weight of a nonionic surfactant; and
e. from about 2 to about 8% by weight of a quaternary ammonium chloride.
f. from about 1 to about 15% by weight of an alcohol solvent selected from diacetone alcohol and lower aliphatic alcohols; and
g. the remainder, water.

2. The composition of claim 1, wherein said diamine is a higher fatty acid diamine.

3. The composition of claim 2, wherein said diamine is tallow diamine.

4. The composition of claim 1, wherein said quaternary ammonium chloride is an alkyl dimethyl benzyl ammonium chloride.

5. The composition of claim 1, wherein said nonionic surface active agent is an adduct of ethylene oxide and a linear alcohol or alkylphenol.

6. The composition of claim 5, wherein said surface active adduct is an adduct of a linear alcohol with ethylene oxide.

* * * * *